US009752463B2

(12) United States Patent
Niu

(10) Patent No.: US 9,752,463 B2
(45) Date of Patent: Sep. 5, 2017

(54) DECOMPRESSION DEVICE FOR INTERNAL COMBUSTION ENGINE

(71) Applicant: Gangxue Niu, Kaifeng (CN)

(72) Inventor: Gangxue Niu, Kaifeng (CN)

( * ) Notice: Subject to any disclaimer, the term of this patent is extended or adjusted under 35 U.S.C. 154(b) by 192 days.

(21) Appl. No.: 14/440,764

(22) PCT Filed: Oct. 31, 2013

(86) PCT No.: PCT/CN2013/086304
§ 371 (c)(1),
(2) Date: May 5, 2015

(87) PCT Pub. No.: WO2014/071817
PCT Pub. Date: May 15, 2014

(65) Prior Publication Data

US 2015/0260059 A1 Sep. 17, 2015

(30) Foreign Application Priority Data

Nov. 6, 2012 (CN) ..... 2012 1 0461057
Feb. 5, 2013 (CN) ..... 2013 2 0090085 U

(51) Int. Cl.
*F01L 1/18* (2006.01)
*F01L 13/08* (2006.01)
(Continued)

(52) U.S. Cl.
CPC ..... *F01L 1/181* (2013.01); *F01L 13/08* (2013.01); *F01L 1/18* (2013.01); *F01L 1/2411* (2013.01);
(Continued)

(58) Field of Classification Search
CPC . F01L 1/181; F01L 1/2411; F01L 2013/0094; F01L 13/08
(Continued)

(56) References Cited

U.S. PATENT DOCUMENTS 5,647,319 A * 7/1997 Uehara ..... F01L 13/06 123/322
6,055,952 A * 5/2000 Gau ..... F01L 13/085 123/182.1
(Continued)

FOREIGN PATENT DOCUMENTS

CN 201041056 Y 3/2008
CN 201756986 U 3/2011
(Continued)

OTHER PUBLICATIONS

International Search Report for Application No. PCT/CN2013/086304 dated Jan. 9, 2014.

*Primary Examiner* — Jorge Leon, Jr.
(74) *Attorney, Agent, or Firm* — Hamre, Schumann, Mueller & Larson, P.C.

(57) ABSTRACT

A decompression device for an internal combustion engine comprises a valve rocker shaft bracket and a valve rod. A valve spring is sleeved on the valve rod, and above the valve rod a valve rocker is arranged. The valve rocker shaft bracket is connected to a decompression bracket. The valve rocker is movably connected to a valve opening/closing device connected with a control device. When the internal combustion engine is started, the valve opening/closing device receives a control command from the control device to keep connecting with the valve rocker for a time, and then disconnect, so that the valve rod arrives at the valve closing position.

11 Claims, 5 Drawing Sheets

(51) Int. Cl.
*F01L 1/24* (2006.01)
*F01L 13/00* (2006.01)

(52) U.S. Cl.
CPC ... *F01L 2013/0094* (2013.01); *F01L 2800/03* (2013.01); *F01L 2820/01* (2013.01)

(58) Field of Classification Search
USPC ..... 123/90.39
See application file for complete search history.

(56) References Cited

U.S. PATENT DOCUMENTS 6,374,792 B1 * 4/2002 Suzuki ..... F01L 13/08 123/182.1
7,216,619 B2 5/2007 Sugiura et al.
7,918,199 B2 * 4/2011 Hashimoto ..... F01L 1/146 123/54.4
2002/0174846 A1 * 11/2002 Ashida ..... F01L 1/02 123/182.1
2005/0161012 A1 * 7/2005 Maeda ..... F01L 13/085 123/182.1
2012/0167861 A1 * 7/2012 Kashima ..... F01L 13/085 123/568.11
2013/0068195 A1 * 3/2013 Ruggiero ..... F02D 13/04 123/321
2014/0182539 A1 * 7/2014 Gron, Jr. ..... F01L 13/08 123/182.1

FOREIGN PATENT DOCUMENTS

CN 102444444 A 5/2012
CN 103244233 A 8/2013
CN 203175640 U 9/2013
JP CN 201041056 Y * 3/2008
JP 2012107715 A 6/2012
JP 5644407 B2 12/2014

* cited by examiner

A-A

DECOMPRESSION DEVICE FOR INTERNAL COMBUSTION ENGINE

CROSS-REFERENCE TO RELATED APPLICATION

The present application is a national phase entry under 35 U.S.C 371 of International Patent Application No. PCT/CN2013/086304, filed Oct. 31, 2013, which claims the priority from Chinese Application Nos. 201210461057.2 filed Nov. 6, 2012 and 201320090085.8 filed Feb. 5, 2013, all of which are hereby incorporated herein by reference.

FIELD OF THE INVENTION

The present invention relates to the field of starting technology of internal combustion engine, and particularly relates to a decompression device for an internal combustion engine.

BACKGROUND OF THE INVENTION

An internal combustion engine is difficult to start, in particular, the problem of a starting system of a high-power diesel engine is more prominent, the failure rate is high, the reliability is poor, in order to solve this problem, people always increase the power of a starter and a storage battery, although the internal combustion engine can be started in this way, since the starting torque of the internal combustion engine still exists, a starting current larger than 1000 A still exists, such that the high failure rate of the starting system cannot be solved fundamentally.

In order to reduce the starting torque of the internal combustion engine, people design a manual decompression starting device on a low-power internal combustion engine, before the internal combustion engine is started, firstly a valve is manually opened to ensure no compression resistance of the internal combustion engine, and after a crankshaft reaches a starting speed, the valve is manually closed, the shortcoming of this method is that both-hand operation is needed, thus being inconvenient to use, and in addition, the valve of a high-power multi-cylinder internal combustion engine requires a very large acting force to be opened manually, therefore the high-power multi-cylinder internal combustion engine is provided with no manual decompression device.

In order to change the manual decompression starting of the internal combustion engine into automatic decompression starting, people propose methods of acting on the valve by air pressure, hydraulic pressure and an electromagnet, but these methods have the shortcomings that a decompression structure occupies a large space, the necessary mechanical force and external electric force are large, numerous components are needed and failure is prone to occur.

SUMMARY OF THE INVENTION

To achieve automatic control during decompression starting of an internal combustion engine, ensure simple structure and few components and achieve high reliability, the present invention provides an inserted cushion block type decompression device for an internal combustion engine.

To achieve the above object, the present invention adopts the following technical solutions:

a decompression device for an internal combustion engine, including a valve rocker shaft bracket and a valve rod, wherein a valve spring is sleeved on the valve rod, a valve rocker is arranged above the valve rod, and the valve rocker shaft bracket is connected to a decompression bracket; the valve rocker is movably connected to a valve opening/closing device connected with a control device; the valve opening/closing device is a device that, when the valve rocker moves downwards before the internal combustion engine is stopped, the valve opening/closing device receives a control command from the control device to connect with the valve rocker, so that the valve rod can not arrive at a valve closing position, and the valve is at an open state; when the internal combustion engine is started, the valve opening/closing device receives a control command from the control device to keep connecting with the valve rocker for a time, and then disconnect, so that the valve rod arrives at the valve closing position; the control device is a device which sends a command to the valve opening/closing device to keep connecting or disconnecting with the valve rocker.

The valve opening/closing device includes a decompression shaft located above the valve rocker, and the decompression shaft is in movable fit with the decompression bracket; a decompression cushion block is sleeved on the decompression shaft, springs are respectively arranged at the two ends of the decompression cushion block, a spring limiting device is arranged at the outside of each spring, and the lengths and elastic forces of the two springs are consistent; the control device is a time-delay relay; an electromagnet is fixed on a valve chamber cover, a movable iron core of the electromagnet is connected with the decompression shaft, the operation of the electromagnet is controlled by the time-delay relay, and when the internal combustion engine is stopped, the decompression cushion block is located between the decompression shaft and the valve rocker.

The spring limiting device is a snap spring.

The spring limiting device includes a shifting fork shaft and a shifting fork on the shifting fork shaft, and the shifting fork limits the springs; the movable iron core of the electromagnet is connected with the decompression shaft through the shifting fork shaft and the shifting fork.

The valve opening/closing device includes an electromagnet fixed on the decompression bracket; the control device is a time-delay relay; the action of the electromagnet is controlled by the time-delay relay, and when the internal combustion engine is stopped, the movable iron core is located between the decompression bracket and the valve rocker.

The valve opening/closing device includes a hydraulic cylinder fixed on the decompression bracket; the control device is a time-delay relay; the action of a piston of the hydraulic cylinder is controlled by the time-delay relay, and when the internal combustion engine is stopped, the piston is located between the decompression bracket and the valve rocker.

The valve opening/closing device includes an electromagnet fixed on the decompression bracket; the control device is a time-delay relay; the action of the electromagnet is controlled by the time-delay relay, a valve cap is installed at the upper end of the valve rod, and when the internal combustion engine is stopped, the movable iron core is located between the decompression bracket and the valve cap.

The valve opening/closing device includes a supporting block and a decompression fulcrum bar driving mechanism, which are fixed at the upper part of a cylinder cover and at the lower part of the valve rocker, the decompression fulcrum bar driving mechanism is connected with a decompression fulcrum bar, and the decompression fulcrum bar is driven by the decompression fulcrum bar driving mechanism to achieve the extension and retraction of the decompression fulcrum bar.

By adopting the above-mentioned technical solutions in the present invention, the occupied space of the decompression starting device is reduced, so that the decompression starting device not only can be well suitable for commercial vehicles, but also can be better installed on passenger cars for use, to achieve automatic control during decompression starting of the internal combustion engines of the passenger cars, moreover, the structure is simple, the components are few, and high reliability is achieved.

DETAILED DESCRIPTION OF THE EMBODIMENTS

Embodiment 1

Figure 1:
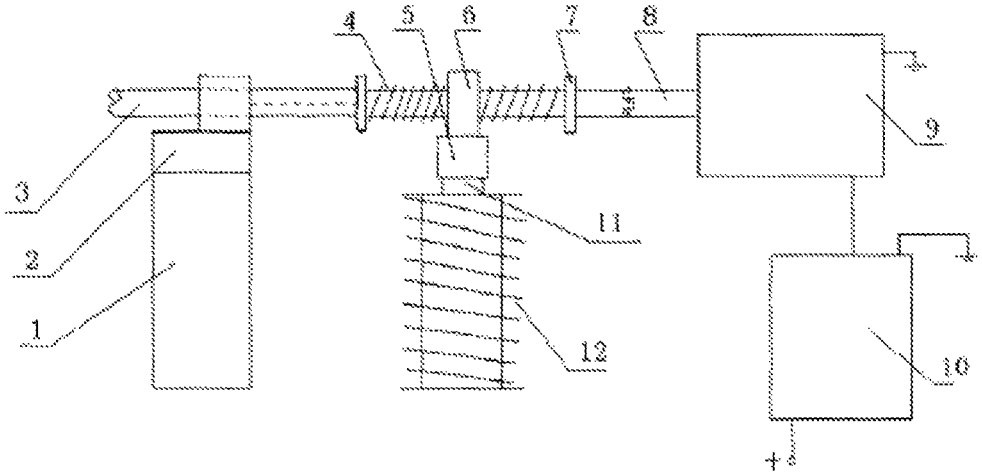
FIG. 1 is a schematic diagram of a structure of embodiment 1 of the present invention.

In FIG. 1, a valve rocker shaft bracket 1, a valve rocker 5, a valve rod 11 and a valve spring 12 are original parts of an internal combustion engine, a decompression bracket 2 is fixed on the valve rocker shaft bracket 1, a decompression shaft 3 is located above the valve rocker 5 and is in movable fit with the decompression bracket 2, a decompression cushion block 6, springs 4 and a snap spring 7 are installed on the decompression shaft 3, the decompression cushion block 6 is located between two springs 4, the lengths and elastic forces of the two springs 4 are consistent, the snap spring 7 limits the positions of the springs 4, an electromagnet 9 is fixed on a valve chamber cover, a movable iron core 8 is fixedly connected with the decompression shaft 3, the operation of the electromagnet 9 is controlled by a time-delay relay 10, and when the internal combustion engine is stopped, the decompression cushion block 6 is located between the decompression shaft 3 and the valve rocker 5.

When the internal combustion engine needs to be stopped, the time-delay relay 10 controls the electromagnet 9, the time-delay relay 10 switches on the circuit of the electromagnet 9, the movable iron core 8 propels the decompression shaft 3 to move towards the direction of the valve rocker 5, the springs 4 are compressed, when the valve rocker 5 drops, the decompression cushion block 6 is located between the valve rocker 5 and the decompression shaft 3, the circuit of the electromagnet 9 is switched off, under the acting force of the valve spring 12, the decompression cushion block 6 is located between the valve rocker 5 and the decompression shaft 3 and cannot be reset, the valve rod 11 cannot arrive at a valve closing position, and the valve is at an open state. When the internal combustion engine needs to be started, a signal is sent to the time-delay relay 10 at first, so that the position of the decompression cushion block 6 is maintained between the valve rocker 5 and the decompression shaft 3, the power supply of a starter is turned on, the starter drives a flywheel to rotate, a crankshaft of the internal combustion engine reaches a starting speed, the time-delay relay 10 switches off the circuit of the electromagnet 9, when the valve rocker 5 moves downwards, the decompression cushion block 6 is reset under the acting force of the springs 4, the valve rod 11 arrives at the valve closing position, and the internal combustion engine is started.

In this invention, the valve rocker naturally drops by means of the operation of the internal combustion engine itself, when a certain space is generated with the decompression shaft, a cushion block is inserted in the space so that the valve rod cannot operate to the valve closing position, and the valve is at the open state. The device only needs a very small acting force for opening the valve, and most components can be placed in the valve chamber cover, so that no space is occupied, installation is simple and convenient, the structure is mechanical, the components are few, the reliability is high and the cost is low.

Embodiment 2

Figure 2:
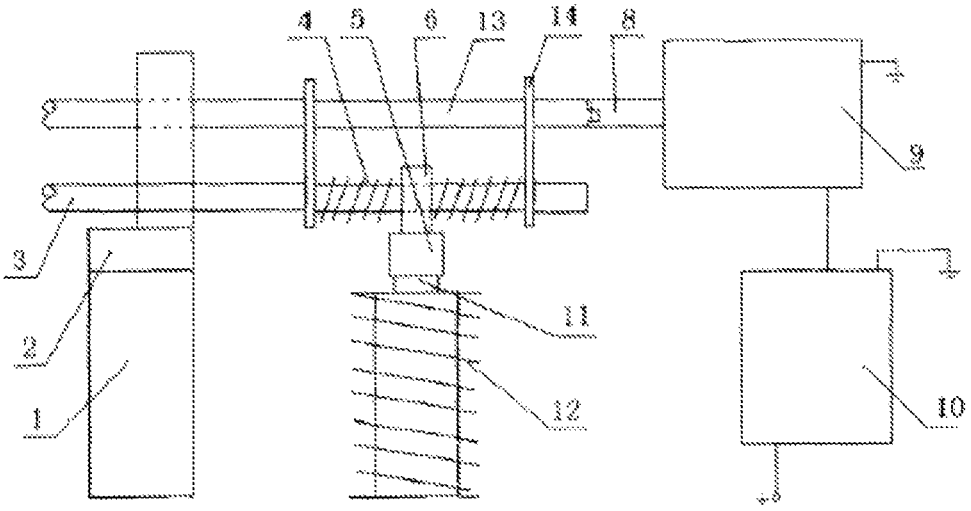
FIG. 2 is a schematic diagram of a structure of embodiment 2 of the present invention.

In FIG. 2, a valve rocker shaft bracket 1, a valve rocker 5, a valve rod 11 and a valve spring 12 are original parts of an internal combustion engine, a decompression bracket 2 is fixed on the valve rocker shaft bracket 1, a decompression shaft 3 is located above the valve rocker and is in stationary fit with the decompression bracket 2, a decompression cushion block 6 and springs 4 are installed on the decompression shaft 3, the decompression cushion block 6 is located between two springs 4, the lengths and elastic forces of the two springs are consistent, a shifting fork shaft 13 is located above the decompression shaft 3 and is in movable fit with the decompression bracket 2, a shifting fork 14 is fixedly connected with the shifting fork shaft 13, the shifting fork 14 limits the positions of the springs 4, an electromagnet 9 is fixed on a valve chamber cover, a movable iron core 8 is fixedly connected with the shifting fork shaft 13, the operation of the electromagnet 9 is controlled by a time-delay relay 10, and when the internal combustion engine is stopped, the decompression cushion block 6 is located between the decompression shaft 3 and the valve rocker 5.

When the internal combustion engine needs to be stopped, the time-delay relay 10 controls the electromagnet 9, the time-delay relay 10 switches on the circuit of the electromagnet 9, the movable iron core 8 propels the shifting fork shaft 13 to move towards the direction of the valve rocker 5, the shifting fork 14 compresses the springs 4, when the valve rocker 5 drops, the decompression cushion block 6 is located between the valve rocker 5 and the decompression shaft 3, the circuit of the electromagnet 9 is switched off, under the acting force of the valve spring 12, the decompression cushion block 6 is located between the decompression shaft 3 and the valve rocker 5 and cannot be reset, the valve rod 11 cannot arrive at a valve closing position, and the valve is at an open state. When the internal combustion engine needs to be started, a signal is sent to the time-delay relay 10 at first, so that the position of the decompression cushion block 6 is maintained between the valve rocker 5 and the decompression shaft 3, the power supply of a starter is turned on, the starter drives a flywheel to rotate, a crankshaft of the internal combustion engine reaches a starting speed, the time-delay relay 10 switches off the circuit of the electromagnet 9, when the valve rocker 5 moves downwards, the decompression cushion block 6 is reset under the acting force of the springs 4, the valve rod 11 arrives at the valve closing position, and the internal combustion engine is started.

Embodiment 3

Figure 3:
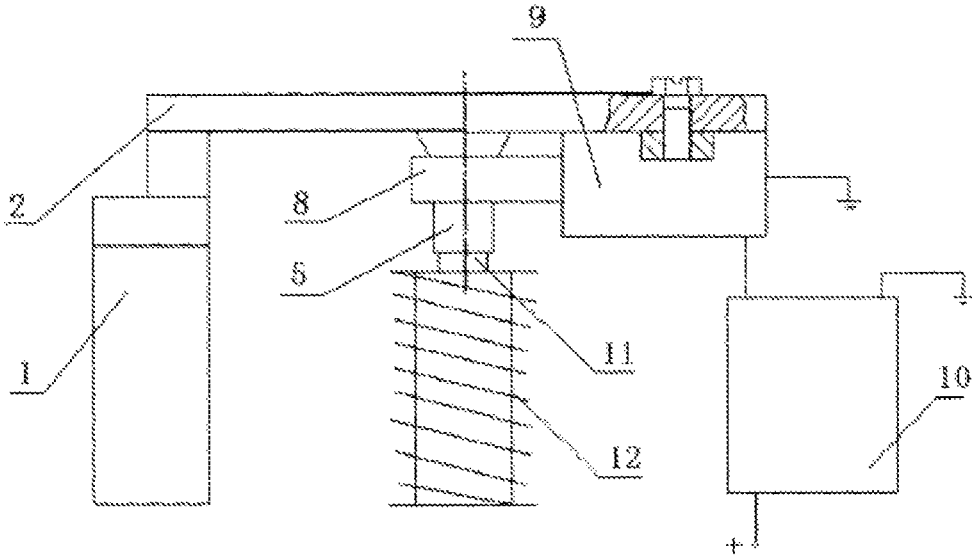
FIG. 3 is a schematic diagram of a structure of embodiment 3 of the present invention.

In FIG. 3, a decompression bracket 2 is fixed on a valve rocker shaft bracket 1, an electromagnet 9 is fixed on the decompression bracket 2, the action of the electromagnet 9 is controlled by a time-delay relay 10, and when the internal combustion engine is stopped, a movable iron core 8 is located between the decompression bracket 2 and a valve rocker 5.

The operating process in embodiment 3 is the same as the operating process of the structure in FIG. 1 of the present invention. When the internal combustion engine needs to be stopped, the time-delay relay 10 controls the electromagnet 9, the time-delay relay 10 switches on the circuit of the electromagnet 9, the movable iron core 8 moves towards the direction of the valve rocker 5, when the valve rocker 5 drops, the movable iron core 8 is inserted between the valve rocker 5 and the decompression bracket 2, when the valve rocker 5 ascends, under the acting force of a valve spring 12, the movable iron core 8 is clamped between the valve rocker 5 and the decompression bracket 2, the circuit of the electromagnet 9 is switched off, the movable iron core 8 cannot be reset, a valve rod 11 cannot arrive at a valve closing position, and the valve is at an open state. When the internal combustion engine needs to be started, a signal is sent to the time-delay relay 10 at first, the circuit of the electromagnet 9 is switched on, so that the position of the movable iron core 8 between the valve rocker 5 and the decompression bracket 2 is not changed, the power supply of a starter is turned on, the starter drives a flywheel to rotate, the crankshaft of the internal combustion engine reaches a starting speed, the time-delay relay 10 switches off the circuit of the electromagnet 9, when the valve rocker 5 drops, the movable iron core 8 is reset, the valve rod 11 arrives at the valve closing position, and the internal combustion engine is started.

Embodiment 4

Figure 4:
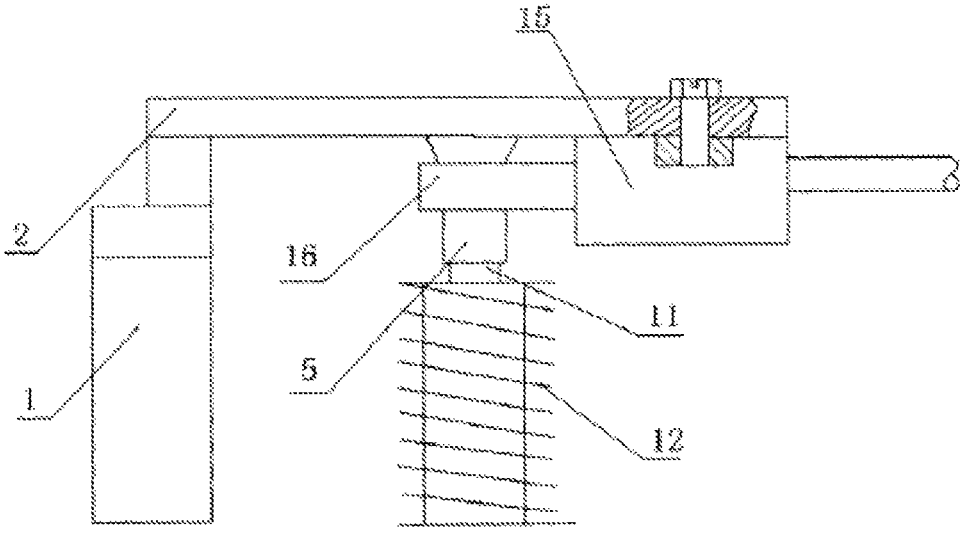
FIG. 4 is a schematic diagram of a structure of embodiment 4 of the present invention.

In FIG. 4, a decompression bracket 2 is fixed on a valve rocker shaft bracket 1, a hydraulic cylinder 15 is fixed on the decompression bracket 2, the action of a piston 16 is controlled by corresponding high pressure oil and a return spring, and when the internal combustion engine is stopped, the piston 16 is located between the decompression bracket 2 and a valve rocker 5.

The operating process in embodiment 4 is the same as the operating process in FIG. 3 of the present invention. When the internal combustion engine needs to be stopped, a time-delay relay 10 controls the action of the hydraulic cylinder 15, certain high pressure oil is supplied to the hydraulic cylinder 15 at first, the piston 16 moves towards the direction of the valve rocker 5, when the valve rocker 5 drops, the piston 16 is inserted between the valve rocker 5 and the decompression bracket 2, under the acting force of a valve spring 12, the piston 16 is clamped between the valve rocker 5 and the decompression bracket 2, the high pressure oil of the hydraulic cylinder 15 is discharged, the piston 16 cannot be reset, a valve rod 11 cannot arrive at a valve closing position, and the valve is at an open state. When the internal combustion engine needs to be started, certain high pressure oil is supplied to the hydraulic cylinder 15 at first, so that the position of the piston 16 between the valve rocker 5 and the decompression bracket 2 is not changed, the power supply of a starter is turned on, the starter drives a flywheel to rotate, a crankshaft of the internal combustion engine reaches a starting speed, the high pressure oil of the hydraulic cylinder 15 is discharged, when the valve rocker 5 drops, the piston 16 is reset, the valve rod 11 arrives at the valve closing position, and the internal combustion engine is started.

Embodiment 5

Figure 5:
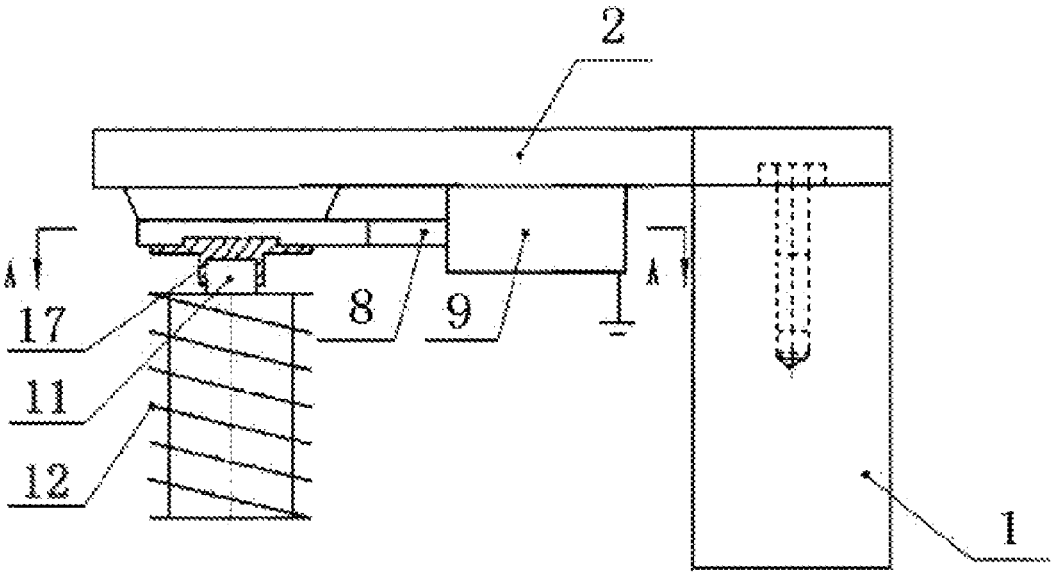
FIG. 5 is a schematic diagram of a structure of embodiment 5 of the present invention.
Figure 6:
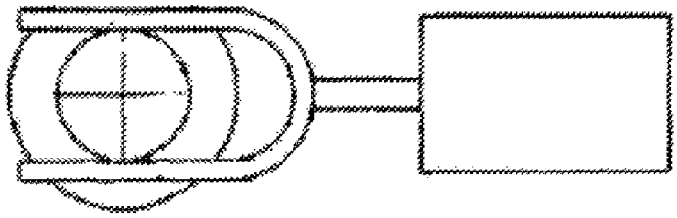
FIG. 6 is a view in an A-A direction of FIG. 5.

In FIGS. 5 and 6, a decompression bracket 2 is fixed on a valve rocker shaft bracket 1, an electromagnet 9 is fixed on the decompression bracket 2, the action of the electromagnet 9 is controlled by a time-delay relay 10, a valve cap 17 is installed at the upper end of a valve rod 11, and when the internal combustion engine is stopped, a movable iron core 8 is located between the decompression bracket 2 and the valve cap 17.

The operating process in embodiment 5 is the same as the operating process of the structure in FIG. 1 of the present invention. When the internal combustion engine needs to be stopped, the time-delay relay 10 controls the electromagnet 9, the time-delay relay 10 switches on the circuit of the electromagnet 9, the movable iron core 8 moves towards the direction of the valve cap 17, when the valve cap 17 drops, the movable iron core 8 is inserted between the valve cap 17 and the decompression bracket 2, when the valve cap 17 ascends, under the acting force of a valve spring 12, the movable iron core 8 is clamped between the valve cap 17 and the decompression bracket 2, the circuit of the electromagnet 9 is switched off, the movable iron core 8 cannot be reset, a valve rod 11 cannot arrive at a valve closing position, and the valve is at an open state. When the internal combustion engine needs to be started, a signal is sent to the time-delay relay 10 at first, the circuit of the electromagnet 9 is switched on, so that the position of the movable iron core 8 between the valve cap 17 and the decompression bracket 2 is not changed, the power supply of a starter is turned on, the starter drives a flywheel to rotate, a crankshaft of the internal combustion engine reaches a starting speed, the time-delay relay 10 switches off the circuit of the electromagnet 9, when the valve cap 17 drops, the movable iron core 8 is reset, the valve rod 11 arrives at the valve closing position, and the internal combustion engine is started.

The operating processes in embodiment 3, embodiment 4 and embodiment 5 are the same as the operating process in FIG. 1 of the present invention, the difference lies in that the opening of each valve is controlled by an electromagnet or a hydraulic oil cylinder, so that the acting force of opening the valve is smaller, and the entire device can be completely installed in the valve chamber cover, so that the external size and the structural form of the existing internal combustion engine are not changed at all, and the device is particularly easy to install on cars.

Embodiment 6

Figure 7:
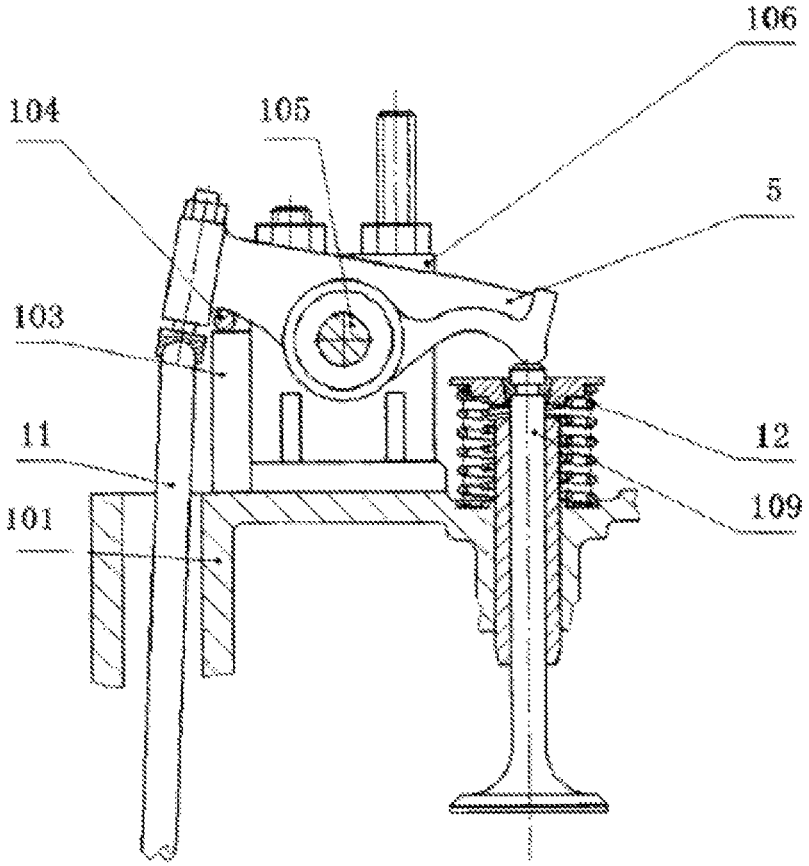
FIG. 7 is a front view of embodiment 6 of the present invention.
Figure 8:
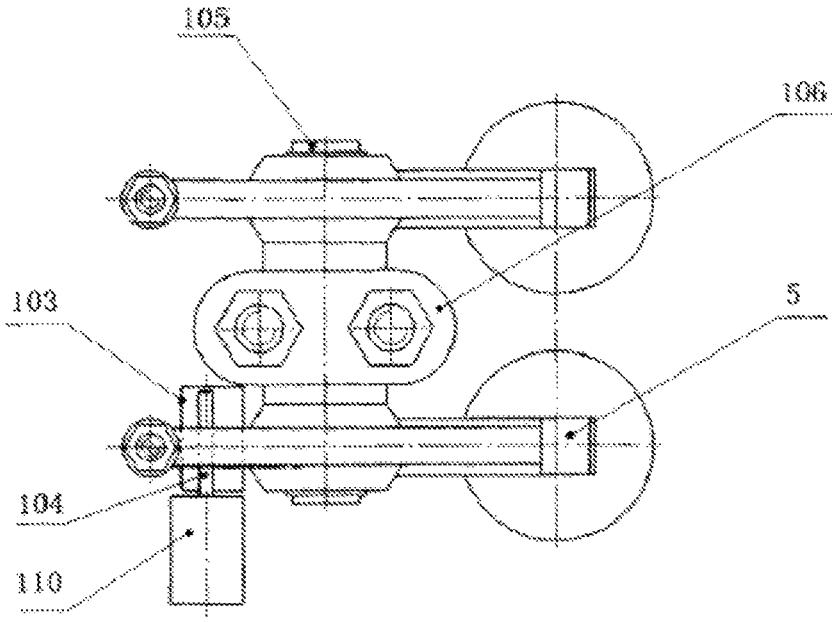
FIG. 8 is a top view of embodiment 6 of the present invention.

In FIGS. 7 and 8, a cylinder cover 101, a valve tappet 11, a rocker seat 106, a rocker 5, a rocker shaft 105 and a valve spring 12 are original parts of an internal combustion engine, a decompression fulcrum bar driving mechanism 110 and a supporting block 103 are fixed at the upper part of the cylinder cover 101 and at the lower part of the rocker 5 (as shown in FIG. 8), a decompression fulcrum bar 104 is connected with the decompression fulcrum bar driving mechanism 110, and the decompression fulcrum bar 104 is driven by the decompression fulcrum bar driving mechanism 110 to achieve the extension and retraction of the decompression fulcrum bar 104.

When the internal combustion engine needs to be stopped, a time-delay relay 10 sends a signal to the decompression fulcrum bar driving mechanism 110 at first, the decompression fulcrum bar driving mechanism 110 drives the decompression fulcrum bar 104 to extend, when one end of the rocker 5 is jacked up by the valve tappet 11 to open a valve 109, a space is generated between the rocker 5 and the supporting block 103, one end of the decompression fulcrum bar 104 extends to the upper side of the supporting block 103 and is stopped, the decompression fulcrum bar 104 contacts the upper surface of the supporting block 103, as shown in FIG. 7, when the rocker 5 drops, the decompression fulcrum bar 104 is located between the rocker 5 and the supporting block 103, the rocker 5 is pressed on the decompression fulcrum bar 104, as shown in FIG. 7, the decompression fulcrum bar 104 on the supporting block 103 blocks the rocker 5 from dropping so that the rocker 5 can not move downwards, the valve 109 cannot arrive at a closing position due to the blocking by the rocker 5, under the acting force of a valve spring 12, the decompression fulcrum bar 104 is clamped between the rocker 5 and the supporting block 103 and cannot be reset, and the valve 109 is at an open state. When the internal combustion engine needs to be started, a signal is sent to the decompression fulcrum bar driving mechanism 110 at first, so that the decompression fulcrum bar 104 is maintained at a position below the rocker 5 to block the rocker 5 from dropping and the valve 109 from closing, the power supply of a starter is turned on, the starter drives a flywheel to rotate, a crankshaft of the internal combustion engine reaches a starting speed, the decompression fulcrum bar driving mechanism 110 drives the decompression fulcrum bar 104 to be reset and retracted, the decompression fulcrum bar 104 does not block the rocker 5 from dropping any more, the valve 109 arrives at the closing position under the action of the valve spring 12, and the internal combustion engine is started to run.

In this invention, the valve rocker and the valve tappet move up and down by means of the operation of the internal combustion engine itself, when the rocker is lifted up, a decompression fulcrum bar is inserted below the rocker, the decompression fulcrum bar is supported by the supporting block, so that the valve corresponding to the rocker cannot operate to the valve closing position, and the valve is at the open state. The device only needs a very small acting force for opening the valve, and most components can be placed in the valve chamber cover, so that the height of the valve chamber cover is not increased, no space is occupied, installation and design of passenger cars are facilitated, installation is simple and convenient, the structure is mechanical, the components are few, the reliability is high and the cost is low.

What is claimed is:

1. A decompression device for an internal combustion engine, comprising:

a valve rocker shaft bracket; and a valve rod, wherein a valve spring is sleeved on the valve rod, and a valve rocker is arranged above the valve rod;

the valve rocker shaft bracket is connected to a decompression bracket;

the valve rocker is movably connected to a valve opening/closing device connected with a control device;

the control device is configured to control the valve opening/closing device;

the control device is a time-delay relay;

when the valve rocker moves downwards before the internal combustion engine is stopped, a space is generated between the valve rocker and a decompression shaft;

the valve opening/closing device receives a control command from the control device to insert a valve limiting device in the space so that the valve opening/closing device connects with the valve rocker, the valve rod cannot arrive at a valve closing position, and a valve is at an open state;

when the internal combustion engine is started, the valve opening/closing device receives a control command from the control device to keep connecting with the valve rocker for a time, and then disconnect, and the valve rod arrives at the valve closing position; and the control device sends a command to the valve opening/closing device to keep connecting or disconnecting with the valve rocker.

2. The decompression device for the internal combustion engine of claim 1, wherein the valve opening/closing device comprises the decompression shaft located above the valve rocker, the decompression shaft is secured in a mounting hole of the decompression bracket, and the decompression shaft is moveable in the mounting hole of the decompression bracket;

a decompression cushion block is sleeved on the decompression shaft, springs are respectively arranged at two ends of the decompression cushion block, the springs are located on the decompression shaft, a spring limiting device is arranged at a side of each of the springs that is away from the decompression cushion block, lengths of each of the springs are equal to each other, and elastic forces of each of the springs are equal to each other;

the decompression cushion block is the valve limiting device; and an electromagnet is fixed on a valve chamber cover, a movable iron core of the electromagnet is connected with the decompression shaft, an operation of the electromagnet is controlled by the time-delay relay, and when the internal combustion engine is stopped, the decompression cushion block is located between the decompression shaft and the valve rocker.

3. The decompression device for the internal combustion engine of claim 2, wherein the spring limiting device is a snap spring.

4. The decompression device for the internal combustion engine of claim 2, wherein the spring limiting device comprises a shifting fork shaft and a shifting fork on the shifting fork shaft, and the shifting fork limits the springs; and the movable iron core of the electromagnet is connected with the decompression shaft through the shifting fork shaft and the shifting fork.

5. The decompression device for the internal combustion engine of claim 1, wherein the valve opening/closing device comprises an electromagnet fixed on the decompression bracket;

the valve limiting device is a movable iron core; and an action of the electromagnet is controlled by the time-delay relay, and when the internal combustion engine is stopped, the movable iron core is located between the decompression bracket and the valve rocker.

6. The decompression device for the internal combustion engine of claim 1, wherein the valve opening/closing device comprises a hydraulic cylinder fixed on the decompression bracket;

an action of a piston of the hydraulic cylinder is controlled by the time-delay relay, and when the internal combustion engine is stopped, the piston is located between the decompression bracket and the valve rocker; and the piston is the valve limiting device.

7. The decompression device for the internal combustion engine of claim 1, wherein the valve opening/closing device comprises an electromagnet fixed on the decompression bracket;

the valve limiting device is a movable iron core; and an action of the electromagnet is controlled by the time-delay relay, a valve cap is installed at an upper end of the valve rod, and when the internal combustion engine is stopped, the movable iron core is located between the decompression bracket and the valve cap.

8. A decompression device for an internal combustion engine, comprising:

a valve rocker shaft bracket; and a valve rod, wherein a valve spring is sleeved on the valve rod, and a valve rocker is arranged above the valve rod;

the valve rocker shaft bracket is connected to a decompression bracket;

the valve rocker is movably connected to a valve opening/closing device connected with a control device;

the control device is a time-delay relay;

when the valve rocker moves downwards before the internal combustion engine is stopped, the valve opening/closing device receives a control command from the control device to connect with the valve rocker, so that the valve rod cannot arrive at a valve closing position, and a valve is at an open state;

when the internal combustion engine is started, the valve opening/closing device receives a control command from the control device to keep connecting with the valve rocker for a time, and then disconnect, and the valve rod arrives at the valve closing position;

the control device sends a command to the valve opening/closing device to keep connecting or disconnecting with the valve rocker;

the valve opening/closing device comprises a decompression shaft located above the valve rocker, the decompression shaft is secured in a mounting hole of the decompression bracket, and the decompression shaft is moveable in the mounting hole of the decompression bracket;

a decompression cushion block is sleeved on the decompression shaft, springs are respectively arranged at two ends of the decompression cushion block, the springs are located on the decompression shaft, a spring limiting device is arranged at a side of each of the springs that is away from the decompression cushion block, lengths of each of the springs are equal to each other, and elastic forces of each of the springs are equal to each other; and an electromagnet is fixed on a valve chamber cover, a movable iron core of the electromagnet is connected with the decompression shaft, an operation of the electromagnet is controlled by the time-delay relay, and when the internal combustion engine is stopped, the decompression cushion block is located between the decompression shaft and the valve rocker.

9. The decompression device for the internal combustion engine of claim 8, wherein the spring limiting device is a snap spring.

10. The decompression device for the internal combustion engine of claim 8, wherein the spring limiting device comprises a shifting fork shaft and a shifting fork on the shifting fork shaft, and the shifting fork limits the springs; and the movable iron core of the electromagnet is connected with the decompression shaft through the shifting fork shaft and the shifting fork.

11. A decompression device for an internal combustion engine, comprising:

a valve rocker shaft bracket; and a valve rod, wherein a valve spring is sleeved on the valve rod, and a valve rocker is arranged above the valve rod;

the valve rocker shaft bracket is connected to a decompression bracket;

the valve rocker is movably connected to a valve opening/closing device connected with a control device;

the control device is a time-delay relay;

when the valve rocker moves downwards before the internal combustion engine is stopped, the valve opening/closing device receives a control command from the control device to connect with the valve rocker, so that the valve rod cannot arrive at a valve closing position, and a valve is at an open state;

when the internal combustion engine is started, the valve opening/closing device receives a control command from the control device to keep connecting with the valve rocker for a time, and then disconnect, and the valve rod arrives at the valve closing position;

the control device sends a command to the valve opening/closing device to keep connecting or disconnecting with the valve rocker;

the valve opening/closing device comprises an electromagnet fixed on the decompression bracket; and an action of the electromagnet is controlled by the time-delay relay, and when the internal combustion engine is stopped, a movable iron core is located between the decompression bracket and the valve rocker.

* * * * *